United States Patent [19]

Moffatt et al.

[11] Patent Number: 4,830,577

[45] **Date of Patent: * May 16, 1989**

[54] IMPULSE PUMP WITH A METAL DIAPHRAGM

[75] Inventors: E. Marston Moffatt, Glastonbury; Richard E. Swarts, Simsbury, both of Conn.

[73] Assignee: United Technologies Corporation, Hartford, Conn.

[ * ] Notice: The portion of the term of this patent subsequent to Feb. 23, 2005 has been disclaimed.

[21] Appl. No.: 179,722

[22] Filed: Apr. 11, 1988

[51] Int. Cl.[4] ..... F04B 43/04; F04B 49/06

[52] U.S. Cl. ..... 417/45; 417/413; 73/505

[58] Field of Search ..... 417/413, 45, 43; 73/505, 516 R, 516 LM; 92/103 M

[56] References Cited

U.S. PATENT DOCUMENTS

| | | | |
|---|---|---|---|
| 2,312,712 | 3/1943 | Hartline | 417/413 |
| 3,381,623 | 5/1968 | Elliott | 417/413 |
| 3,587,328 | 6/1971 | Schuemann | 75/516 LM |
| 4,254,659 | 3/1981 | Benedetto et al. | 73/516 LM |
| 4,295,373 | 10/1981 | Moffatt | 73/505 |
| 4,305,293 | 12/1981 | Swartz | 73/505 |
| 4,314,202 | 2/1982 | Okubo | 324/207 |
| 4,716,763 | 1/1988 | Moffatt et al. | 73/505 |
| 4,726,227 | 2/1988 | Moffatt et al. | 73/505 |

FOREIGN PATENT DOCUMENTS

| | | | |
|---|---|---|---|
| 57-211561 | 12/1982 | Japan | 73/516 LM |
| 0617716 | 7/1978 | U.S.S.R. . | |

OTHER PUBLICATIONS

Official Gazette, p. 1936, dated 4/28/87.
Official Gazette, 1084 OG 23, dated 11/17/87.

*Primary Examiner*—Carlton R. Croyle
*Assistant Examiner*—Eugene L. Szczecina, Jr.
*Attorney, Agent, or Firm*—Francis J. Maguire, Jr.

[57] ABSTRACT

A metal diaphragm impulse pump with no valves is disclosed. The pump may be used in an angular velocity sensor utilizing the Coriolis effect on a fluid jet. A magnetic core is mounted within an anvil and a drive coil is wound around the core. The drive coil may be driven sinusoidally and the diaphragm, which is mounted on the anvil responds with a vibratory motion in like manner. Sensing poles are provided in quadrature with the drive coils and may be used to sense the vibratory motion and thereby control the fluid flow.

5 Claims, 4 Drawing Sheets

IMPULSE PUMP WITH A METAL DIAPHRAGM

CROSS REFERENCE TO RELATED APPLICATIONS

The invention described herein may employ some of the teachings disclosed and claimed in commonly owned U.S. Pat. No. 4,726,227 by Moffatt et al, entitled ANGULAR VELOCITY SENSOR HAVING LOW TEMPERATURE SENSITIVITY; and U.S. Pat. No. 4,716,763, also by Moffatt et al, entitled JET FLOW IN AN ANGULAR VELOCITY SENSOR.

1. Technical Field

This invention release to an impulse pump for an angular velocity sensor having sensing elements cooled differently by a fluid jet in the presence of sensor rotation.

2. Background Art

Fluid jet angular velocity sensors utilizing sensing elements for sensing the speed of rotation are well known in the art. U.S. Pat. Nos. 3,500,690 to Schuemann, 4,020,700 to Lopicolo et al, and 3,581,578 to Schuemann, all disclose fluid jet angular velocity sensors having a pair of sensing elements for sensing the speed of rotation about an axis perpendicular to a "plane of sensitivity".

The sensing elements are usually positioned symmetrically about a reference jet axis with each element on opposite sides and at equal distances therefrom. A fluid jet is directed along the reference jet axis from a nozzle which cools the sensing elements in substantially equal proportions in the absence of sensor rotation. Due to the well-known Coriolis effect, the fluid jet impinges nonsymmetrically, i.e., the fluid jet "bends" in the presence of sensor rotation. Because of the well-known characteristic of fluid jets in which the higher velocity fluid particles are concentrated at the center of the jet and the lower velocity particles around its periphery, the sensing elements are cooled in different proportions whenever the fluid jet impinges nonsymmetrically upon the sensing elements.

One source of unrepeatability in prior art angular rate sensors is caused by the basic properties of the piezoelectric material (PZT) used to construct the pump diaphragm. The PZT material is subject to temperature hysteresis. This shows up as a change, for example, in the pump impedance (and hence in the flow rate) at room temperature when the pump is either heated or cooled to the test limits to positive 155 degrees Fahrenheit or negative 35 degrees Fahrenheit and then returned to room temperature. This error (in terms of the original values) gradually disappears if the pump is kept at room temperature, but it can take as long as a week for this to occur. This phenomenon is well-known for materials with high dielectric constants and also affects capacitors.

With a PZT diaphragm, the deflection is a direct function of voltage and thickness. Changing the thickness is a very time consuming manufacturing operation and it has been found that there is a definite limit on minimum thickness because of manufacturing difficulties with the crystal material itself. Maximum voltage is limited by depoling effects. Thus, both minimum frequency and maximum deflection are limited by properties of the PZT material itself.

The PZT pump suffers from differential expansion problems and PZT pumps require specialized manufacturing techniques. The PZT material has a very low coefficient of expansion which requires the anvil 28 to be made of INVAR to match it, but that results in an anvil material which does not match the coefficient of the nozzle block.

Another source of temperature sensitivity is the use of extremely thin sensing wire. A further source of temperature sensitivity is temperature hysteresis effect in the sensor itself.

Thus, in practice, it has been found that angular velocity sensors of this type are highly sensitive to temperature variations. A need exists to find ways to minimize temperature sensitivity in angular rate sensors of this kind.

DISCLOSURE OF THE INVENTION

The object of the present invention is to provide an improved impulse pump for minimizing temperature sensitivity and improving flow thereby increasing accuracy in angular rate sensors.

According to the present invention an electromagnetically driven metal diaphragm pump is provided for use as an impulse pump in an angular rate sensor. The pump includes a metal anvil for mounting the metal diaphragm. A flexure may be interposed between the anvil and diaphragm. The pump also includes a magnetic core mounted within the anvil and having a drive coil wound thereon. The core provides a low reluctance path for magnetic drive flux in a magnetic drive circuit which includes the core, the diaphragm, and an air gap between the core and the diaphragm. An AC drive signal is provided to the drive coil and the resulting time-varying magnetic flux causes the diaphragm to vibrate in an oscillatory manner. The magnitude of the vibratory motion, i.e., the amplitude of the diaphragm displacement, controls the fluid flow rate in the jet stream within the sensor. The pump also includes sensing poles with sensing coils wound thereon and mounted in quadrature with respect to the drive coil. The sensing poles provide a low reluctance path for magnetic sensing flux in a magnetic circuit in which a sensing signal is induced by virtue of the vibratory motion of the diaphragm. The sensed signal is indicative of diaphragm displacement amplitude and frequency and is used by a control circuit to control the fluid flow rate.

The present invention provides a highly effective 5 means of improving temperature sensitivity in an angular rate sensor. The use of a metal diaphragm pump driven electromagnetically eliminates the temperature hysteresis problem of the prior art, and provides a higher mechanical Q which compensates for the theoretically less efficient electrical operation of a metal diaphragm. Since the electrical load of the pump is such a small part of the system power requirements (on the order of 1%) an increase in power required can be easily tolerated.

There are numerous advantages achieved by the use of a metal diaphragm pump. These include repeatability due to the absence of temperature hysteresis. Flexibility of design is enhanced with respect to certain voltage and frequency constraints to be described below. The optimum frequency for the best mode embodiment of the invention is difficult to achieve using PZT diaphragms.

PZT material has a very low coefficient of expansion so the flexure and anvil are made of INVAR to match it, but this doesn't match the coefficient of the nozzle block.

A metal diaphragm pump can be made of a single material which can be matched to the nozzle block thus eliminating differential expansion problems.

Manufacturing of the electro-magnetic pump involves standard machining techniques with common materials so the choice of vendors is very wide, whereas the piezoelectric diaphragm is so specialized, that there are very few sources of supply.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1A:
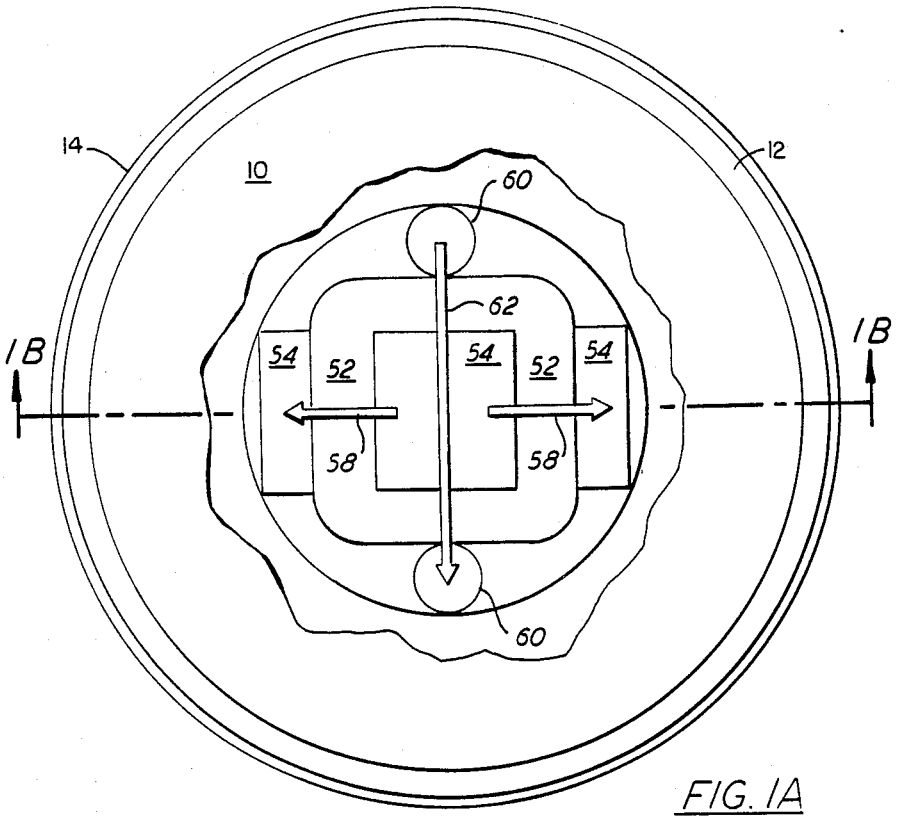
FIG. 1A is a plan and IB a section view of a pump assembly according to the present invention.

FIG. 1A shows a plan and 1B a section view of a pump assembly according to the present invention. A metal diaphragm 10 may be welded or soldered to a flexure 12 which in turn is welded to an anvil 14. A drive coil 52 may be wound around the central post of a laminated core 54. A coil support plate 56 may be welded to the anvil 14 to support the laminated core 54 and the drive coil 52.

In this configuration, the drive coil 52 produces magnetic flux which is shown pictorially by lines 58. The magnetic flux path includes a path through the laminated core 54, an air gap between the diaphragm 10 and the laminated core 54, the diaphragm 10 itself, and back through the air gap between the diaphragm and the outside of the laminated core. The diaphragm is caused to vibrate at a selected frequency by energizing the drive coil 52 with AC at that frequency.

Sensing poles 60 are shown in FIG. 1A producing sensing flux 62 in quadrature with the drive flux 58. The sensing flux is used to sense the amplitude of the deflection and the phase of the vibratory deflection motion with respect to the drive current.

The diaphragm 10 and the core 54 are of magnetic steel such as the silicon alloys TRANSCOR or SILECTRON or a nickel-iron steel such as Allegany Ludlum 4750 or SUPERMALLOY. These steels have approximately the same coefficients of expansion as the 400 series stainless steels so they do not introduce temperature stresses. They also have especially low magnetic hysteresis losses and when used in thin sheets (0.005–0.015cm) have low eddy current losses so that electrical losses in the magnetic circuit are minimized.

The diaphragm 10 may be resistance-welded to a thin flexure 12 of compatible steel such as a 400 stainless steel. The flexure 12 may be resistance-welded to the stainless steel anvil 14.

This particular structure is similar to the prior art design using a PZT bimorph for a diaphragm except that the prior art flexure 12 and anvil 14 were INVAR and the flexure as tin-lead-soldered to the bimorph.

According to the present invention, the flexures 12 are stamped parts and the diaphragms are cut from standard sheet stock s this part of the assembly is much cheaper than the prior art PZT structure.

The drive coil 52 may be wound on a magnetic E-core structure 54, having three poles.

Figure 2:
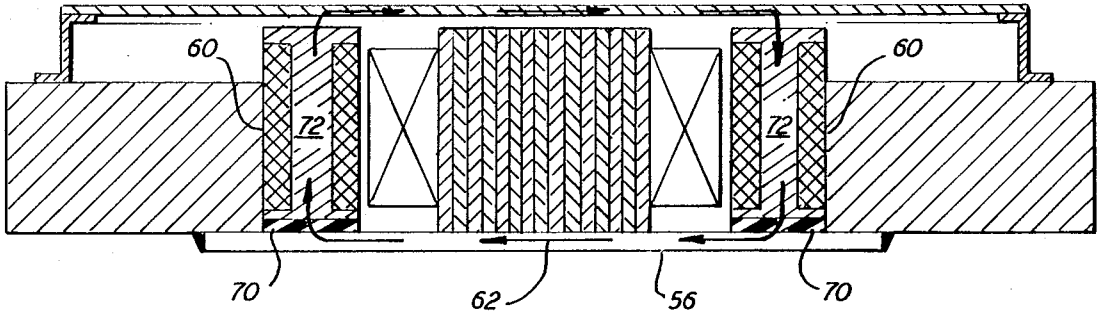
FIG. 2 is a section view of the pump of FIG. 1, showing sensing coils.

The additional sense poles 60 are shown in more detail in FIG. 2. The magnetic circuits of the drive and sense coils are independent of each other because they are arranged in quadrature. Thus the drive current will not induce any voltage in the sense coils. This is essential for the operation described below.

The sensing flux 62 of FIG. 2 is shown passing through the support plate 56 and through a pair of permanent magnets 70. The sensing flux is produced by the magnets 70 and the movement of the diaphragm changes the magnetic field strength sensed as a voltage by the sensing coils 60 which are coiled around magnetic steel cores 72. Faraday's law is operative here, as evidenced by the current flow induced in the sense coils due to the changing magnetic field strength.

Figure 1B:
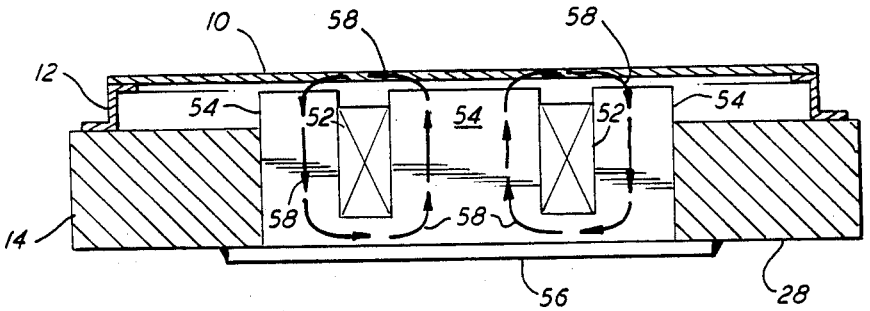

A magnetic device of the type shown in FIGS. 1A, 1B and 2 requires a fixed DC magnetic bias for the drive circuit in addition to an AC magnetizing drive current. Of course, the bias could be supplied either by a permanent magnet in the circuit or by a DC current superimposed in the AC. However, it requires less power to use a DC bias current rather than magnets in the drive circuit. This is because the magnets increase the magnetic reluctance of the drive coils so much that the total power consumption is greater. On the other hand, for the sense coils, magnets are preferred because these coils only produce a voltage which is fed into a high impedance electronic circuit. So, for the sensing coils, this type of bias simplifies the electronics and reduces power consumption. However, either method may be used for either circuit.

The purpose of the sense coils as twofold:

(1) they measure diaphragm movement and thus supply a signal that can be applified and used to control drive current at the proper phase angle to make the device automatically operate at its resonant frequency and;

(2) they are used to measure the product of diaphragm displacement and frequency by using the following equations:

$$E = -10^{-8} N \frac{d\phi}{dt},$$

where,

N=number of turns, and $\phi$=flux.

Since the flux varies inversely with the gap, with a fixed magnetic bias created by the permanent magnets, $$\frac{d\phi}{dt} = 2\pi f \phi_o \left[ \frac{\Delta g}{g_o} \right] \cos\omega t, \text{ and}$$

$$E_{max} = 10^{-8} N(2\pi f) \left[ \frac{\Delta g}{g_o} \right] \phi_o,$$

where f=frequency g=air gap variation due to diaphragm movement, $g_o$=mean air gap, and $\phi_o$=mean flux.

Since N, $g_o$, and $\phi_o$ are fixed, $E_{max}$ is proportional to:

$$(f \cdot \Delta g).$$

This quantity is proportional to the volumetric displacement of the pump which in turn determines the flow rate through a fixed nozzle.

Thus, the absolute voltaqe from the sense coils can be used as a feedback control signal for controlling the drive current. By programming the desired sense voltage at each temperature, the flow rate can be set independently of any changes in the pump hysteresis characteristics.

It should be noted that a diaphragm can be driven with an AC current alone without any bias flux or current but it will then run at double the line frequency. This mode entails higher electrical losses and makes operation at self-resonance more difficult. Therefore it is less desirable than the method described above but still useable.

Figure 3A:
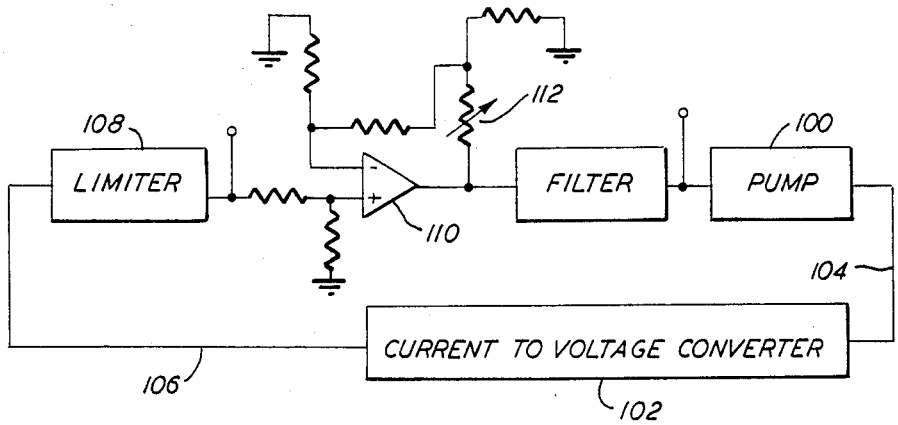
FIG. 3*a* is a simplified block diagram illustration of a drive circuit for driving the metal diaphragm pump of FIGS. 1 & 2.

Referring now to FIG. 3*a*, a block diagram illustration of a circuit for driving the metal diaphragm pump of FIGS. 1 & 2 is shown. The block diagram illustrates an oscillator circuit having the textbook amplification of:

$$K_R = \frac{K}{1 - \beta K},$$

where

K=amplification of the oscillator amplifier, $\beta$=ratio of the feedback voltage to the output voltage, and $K_R$=ratio of the output signal voltage to the input signal voltage.

For oscillation to occur, the magnitude $\beta$K must equal unity and the phase angle must equal zero or some whole number multiple of two pi. The circuit includes a pump 100, a current to voltage converter 102 which may be viewed as converting the pump current on a line 104 to a voltage on a line 106, a limiter 108, and an amplifier 110 whose gain is controlled by a thermister 112. The ability of the circuit of FIG. 3*a* to change the pump flow rate by using thermister 112 to change the gain of amplifier 110 is relatively poor in certain extreme temperature ranges.

Figure 3B:
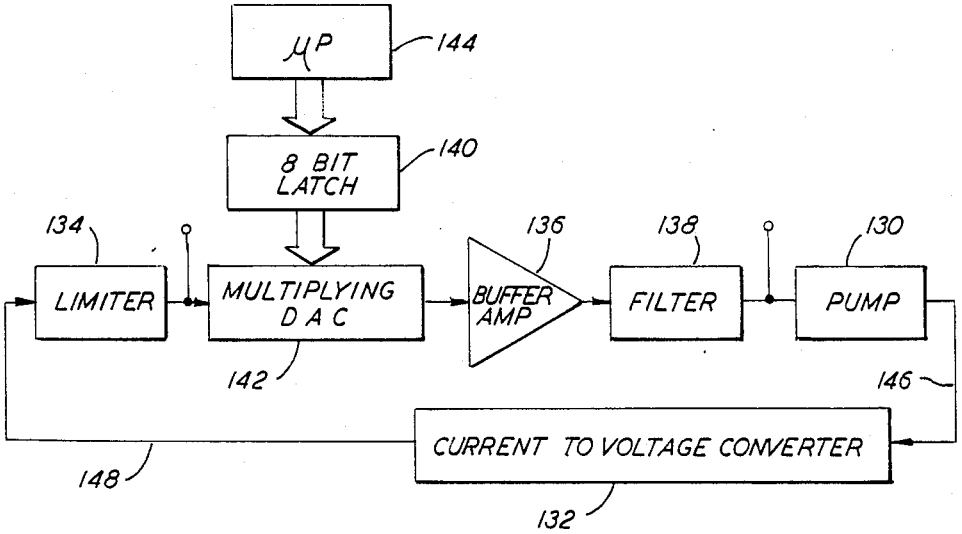
FIG. 3*b* is an alternate simplified block diagram illustration of a drive circuit for driving the metal diaphragm pump of FIGS. 1 & 2.

FIG. 3*b* shows an alternate drive circuit for driving the metal diaphragm pump of FIGS. 1 & 2. It also includes a pump 130, a current to voltage converter 132, a limiter 134, an amplifier 136, and a filter 138. However, the circuit of FIG. 3*b* also contains an 8-bit latch 140 which, in conjunction with a multiplying DAC 142, performs as an electronic attenuator under software control as dictated by a microprocessor 144. A pump current signal on a line 146 is converted to a voltage signal on a line 148 by means of the current to voltage converter 132, passed through the limiter 134 and then applied to the input of the multiplying DAC 142. The attenuated signal is then buffered in the buffer amplifier 136, filtered in the filter 138 to produce a sinusoidal voltage signal to drive the pump 130. The voltage applied to the pump determines the diaphragm's oscillatory amplitude, and hence the flow rate of the jet. By means of calibration software the desired pump voltage versus temperature can be obtained automatically with look-up tables stored in EPROM (not shown). In the design of FIG. 3*a*, a manual trim must be inserted to set the nominal pump voltage add the desired temperature compensation is obtained by use of the thermister 112. This method has its limitations as discussed previously. The programmable version of FIG. 3*b*, on the other hand, allows the pump to be fine-tuned by setting the DAC to the desired attenuation throughout the temperature range. The diaphragm is caused to vibrate at a selected frequency by energizing the drive coil 52 (see FIG. 1) at that frequency.

Figure 4:
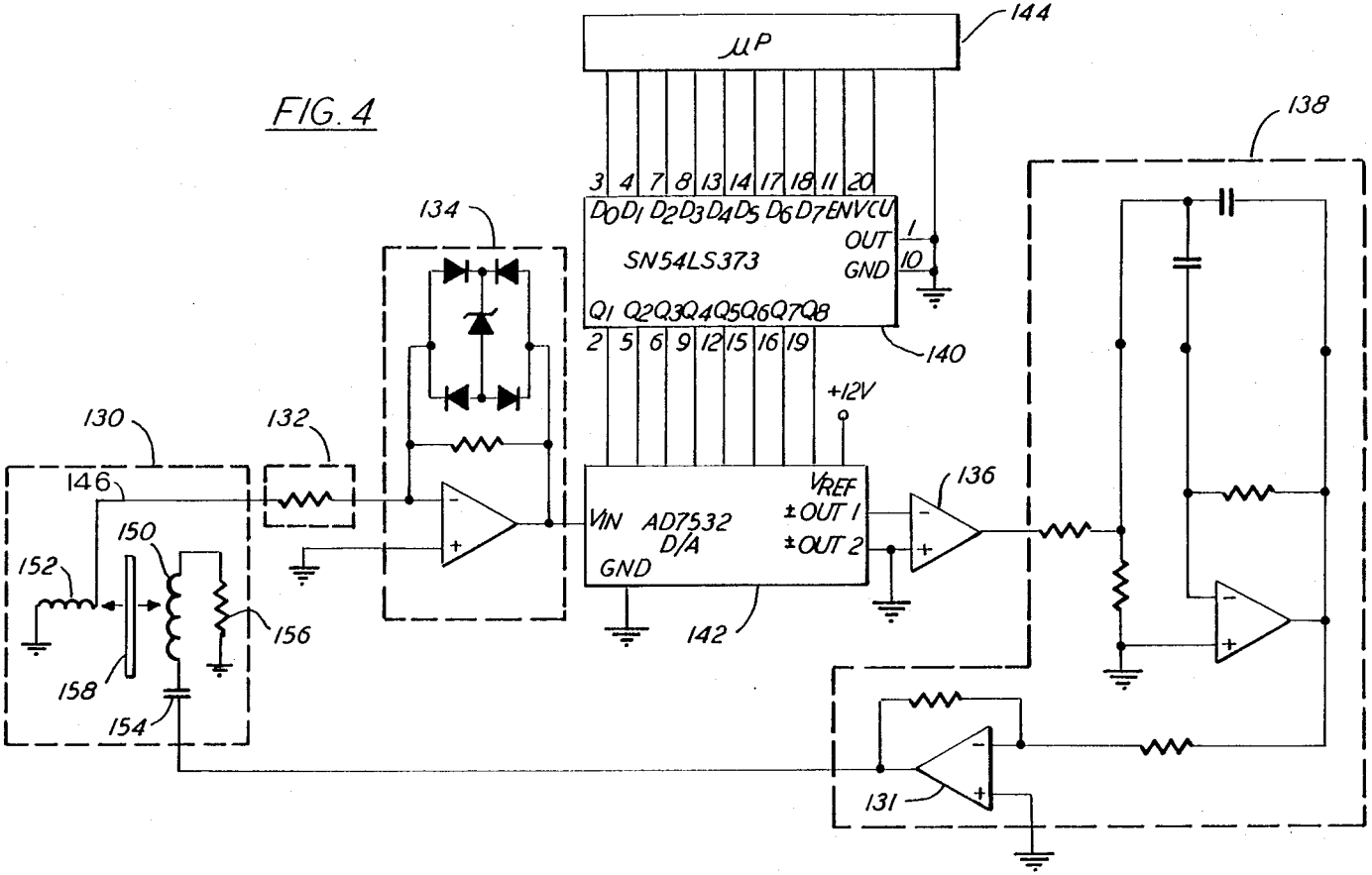
FIG. 4 is a more detailed schematic block diagram illustration of the circuit of FIG. 3*b*.

FIG. 4 is a more detailed illustration of the circuitry of FIG. 3*b*. The illustration of FIG. 4 is provided merely to show one implementation of the concepts presented in FIG. 3*b*. Of course, it should be understood that FIGS. 3*a* and 3*b* themselves are likewise merely two of many possible circuit variations which may be used to carry out the invention.

The pump 130 in FIG. 4 is shown having a drive coil 150 and a sense coil 152. The drive coil 150 is part of a series resonant circuit which includes a capacitor 154 and a resistor 156. The series resonant circuit is driven at its resonant frequency by an amplifier 131. This causes a diaphragm 158 to vibrate because of the manner in which the magnetic circuit is formed as described previously in connection with FIGS. 1A, 1B and 2. The sensing coil 152 is arranged in quadrature with respect to the drive coil 150 and therefore does not couple any of the drive current. However, the diaphragm also forms part of a magnetic circuit which includes the sensing coil's core and the diaphragm's oscilatory movement causes an oscillatory change in the magnetic flux coupling the sensing coil 152 which is picked up as a voltage b the sensing coil 152 by virtue of Faraday's Law (there may be a permanent magnet 70 in the sensing coil's magnetic circuit). Thus, the sensing coil is enabled to provide a feedback signal on the line 146 to the I to V converter circuitry 132. Since the feedback gain is preselected to a value of unity the oscillations in the drive coil are sustained.

Although the invention has been shown and described with respect to a best mode embodiment thereof, it should be understood by those skilled in the art that the foregoing and various other changes, omissions, and additions in the form and detail thereof maybe made therein without departing from the spirit and scope of the invention.

That which we claim, and desire to secure by Letter Patents, is:

1. An impulse pump driven by a time-varying excitation voltage for use in an angular velocity sensor, comprising:

a metal anvil having a cavity;

a metal diaphragm mounted over said cavity;

a magnetic steel laminated core mounted in said anvil's cavity and having drive poles for providing a low reluctance path for magnetic drive flux in a magnetic drive circuit including said core, said diaphragm, and a gap between said core and said diaphragm;

a drive coil wound on said laminated core, said drive coil being responsive to the excitation voltage for providing said drive flux;

a magnetic sensing circuit including sensing poles, means for providing sensing flux, said diaphragm, and a gap between said sensing poles and said diaphragm, for providing a low reluctance path for magnetic sensing flux induced in said magnetic sensing circuit by said means for providing sensing flux, said low reluctance path for sensing flux being disposed at right angles to said low reluctance path for magnetic drive flux; and a sensing coil wound on said sensing poles, for having a sensing signal induced therein in response to said sensing flux, said sensing signal controls said exciting voltage thereby controlling the flow rate of said impulse pump.

2. The pump of claim 1, wherein said magnetic steel laminated core is E-shaped having said drive coil wound on its central leg and having its outer legs as said drive poles.

3. The pump of claim 1, further comprising a metal flexure disposed between said anvil and said diaphragm which is attached to said anvil and to said diaphragm for providing a structure for facilitating formation of said gap between said core and said diaphragm and for providing a structure for facilitating formation of said gap between said sensing poles and said diaphragm.

4. The pump of claim 1, further comprising:

oscillator circuit means, having said drive coil connected in a resonant circuit as an element thereof;

said oscillator circuit responsive to a feedback signal, for providing oscillatory drive current to said drive coil and for driving said resonant circuit substantially at its resonant frequency at a selected amplitude; and feedback circuit means, responsive to said sensing signal for providing said feedback signal in phase for overcoming energy losses in said resonant circuit, thereby sustaining said oscillatory current at said resonant frequency and said selected amplitude.

5. The impulse pump of claim 1, wherein said means for providing sensing flux comprises permanent magnets.

* * * * *